US005643362A

United States Patent [19]

Garves

[11] Patent Number: 5,643,362

[45] Date of Patent: Jul. 1, 1997

[54] CENTERLESS TURNING LATHE FOR REFINISHING ROLLERS

[76] Inventor: John C. Garves, 15601 Bondy La., Darnestown, Md. 20878

[21] Appl. No.: 463,944

[22] Filed: Jun. 5, 1995

[51] Int. Cl.[6] ..... B05C 1/00

[52] U.S. Cl. ..... 118/264; 118/500

[58] Field of Search ..... 118/264, 500; 269/909

[56] References Cited

U.S. PATENT DOCUMENTS

| | | | |
|---|---|---|---|
| 3,389,009 | 6/1968 | McNulty et al. | 427/184 |
| 4,088,800 | 5/1978 | Nicholson | 427/8 |
| 4,089,294 | 5/1978 | Lasiewick et al. | 118/230 |
| 4,213,419 | 7/1980 | Nicholson | 118/670 |
| 4,869,200 | 9/1989 | Euverard | 118/200 |
| 5,029,555 | 7/1991 | Dietrich et al. | 118/500 |
| 5,180,262 | 1/1993 | Rendell | 410/12 |
| 5,183,509 | 2/1993 | Brown et al. | 118/500 |
| 5,387,286 | 2/1995 | Manor | 118/500 |

OTHER PUBLICATIONS

Recent advertisement in a journal for Plastic Tooling Corporation's Laser Tools System (undated).

*Primary Examiner*—Laura Edwards

*Attorney, Agent, or Firm*—James Creighton Wray

[57] ABSTRACT

A centerless turning lathe refinishes multiple laser printer rollers, mags and PCRs simultaneously. The apparatus includes a housing having two members connected by multiple rods. Multiple spindles extend inward from the members. Each spindle has recesses for carrying an O-ring. The O-ring is easily moved from recess to recess along the spindles to accommodate any length of roller. Adapters may be placed over the ends of the spindles for securing and rotating shorter rollers, mags and PCRs. The spindles extending from the members are power-driven by a speed controlled motor. Finely adjustable T-shaped fences extend through holes in the members above the spindles and hold the rollers longitudinally. An applicator assembly for applying chemicals to the rollers includes a guide positioned on and extending between the members of the housing, a movable carriage that travels along the guide, and a multiple treatments foam applicators extending from the carriage. The applicator can be manually operated or automatically driven. For refinishing applications, rollers are positioned in the housing between the two members and are laid on the spindle O-rings. The motor is activated, causing the spindles and rollers to rotate. Chemicals are applied to the surfaces of the rotating rollers either manually or automatically to clean and then to coat the rollers using the multi-pronged applicator.

18 Claims, 9 Drawing Sheets

CENTERLESS TURNING LATHE FOR REFINISHING ROLLERS

BACKGROUND OF THE INVENTION

The present invention relates generally to remanufacturing machines for refinishing recyclable computer laser printer components.

Recycling the drums, mags and rollers of laser printers needs to be easy and efficient.

Existing machines have proven inadequate in addressing those needs. Existing refinishing lathes require a single workpiece to be centered on a pair of opposing chucks. Existing lathes allow only one workpiece to be refinished at a time. The workpiece is rotated and a technician refinishes the workpiece using a handheld, nonguided applicator. Removal of the refinished workpiece from the apparatus inevitably results in damage to the refinished surface, as fingers contact the surface when the workpiece is forcibly disengaged from the chucks.

Existing apparatus demand exact precision on the part of technicians. That decreases productivity and limits the usefulness of the apparatus.

Recycling is economically feasible only when recycling expenses are minimized and high quality is maintained. Existing refinishing machines are expensive and lack the productivity output to justify the expense. Needs exist for refinishing machines that are low cost in light of production levels, that allow multiple workpieces to be refinished at one time and that restore workpieces to near-original quality.

SUMMARY OF THE INVENTION

A refurbishing apparatus has a centerless turning lathe for refinishing laser printer rollers, mags and PCRs (primary corona rollers).

The apparatus includes a housing having two end walls connected by multiple rods. A set of spindles extends inward from each end wall. Each set has an equal number of spindles. The spindles in each set are arranged in a horizontal row. Each spindle has recesses for receiving an O-ring. The O-rings are easily relocated from recess to recess along the length of the spindle for accommodating different workpiece lengths. Each end of the workpiece is supported on O-rings of two spindles. Removable chucks are fitted to the ends of spindles to extend spindle length for refinishing short length workpieces.

A variable speed motor drives both sets of spindles. Elongated O-rings connect adjacent spindles and serve as drive belts. All the spindles in the driven set rotate in the same direction. The driven spindles rotate the workpieces, allowing chemicals to be applied to outer surfaces of the workpieces easily without adjusting the applicators.

T-shaped fences extend inward from the walls above the spindles and axially support the ends of the workpieces. Each fence has a threaded shaft and a head. The shaft of each fence extends through an opening in the wall. The openings have larger upper parts and smaller threaded lower parts. The fences are fine adjusted by first lifting and sliding the shaft through the large upper part of the opening and then by dropping the shaft into a smaller threaded lower part of the opening and turning the shaft. Each fence head abuts the workpiece ends for holding the workpieces longitudinally and has projections which fit into axial openings in the workpieces for holding the workpieces against "radial" or lateral motion.

Rollers, mags, PCRs and other workpieces to be refinished are supported by the spindles. The ends of the workpieces are laid on the O-rings on the spindles. The motor is turned on, causing the spindles and the workpieces to rotate. Cleaning and coating chemicals are applied to the outer surfaces of the rotating workpieces using applicators. When multiple workpieces are rotated at one time, a carriage having multiple treatment foam applicators is used to allow all workpieces to be refinished in a single pass of the carriage.

One embodiment of the apparatus has a manual applicator that travels along a guide path. The guide path includes a pair of mounts that removably rest on opposite side walls of the housing. A pair of rails extend between the pair of mounts. A hand operated carriage has grooves in a lower surface for receiving the rails of the guide path. Treatment foam applicators removably extend from a side of the carriage closest to the workpieces. The guide path, carriage and treatment foam applicators are oriented such that tips of the treatment foam applicators contact workpieces near the uppermost point of rotation. That orientation prevents workpieces from jumping off the spindles when the workpieces are contacted. A technician systematically moves the carriage along the guide path, contacting the rotating workpieces with the treatment foam applicators. The guide path ensures precision and provides for consistently finished workpieces. The multipronged carriage allows multiple workpieces to be refinished in one pass, thus increasing efficiency and productivity.

Automated applicators are readily incorporated in the present invention. First and second rails extend between the end walls of the housing above the workpieces. A carriage carrying multiple treatment foam applicators travels along the rails. Similar to the manually operated applicators, the carriage, treatment foam applicators and rails are oriented such that the tips of the treatment foam applicators touch the workpieces at near the uppermost point of rotation. The carriage is driven by a lead screw and a spring-urged follower that moves from left to right as the carriage traverses the rails. The follower trips out the screw-drive engagement upon reaching the home stop, or end point.

For cleaning and preparation purposes, a roller carriage assembly traverses the rotating workpieces. Parallel rails extend from the top of the end walls and connect the end walls. A carriage extends between and travels along the parallel rails. A parallel handle is supported by cranks that pivotally extend from the carriage. A solvent-soaked roller or pad is positioned around a crossbar extending between the cranks. When activated, the handle is pivoted, allowing the roller to contact the rotating workpieces, and the carriage travels along the parallel rails.

Ends of the workpieces are laid on O-rings positioned around adjacent spindles. If there are X number of spindles in each set, X-1 workpieces can be refinished with one pass of an applicator. Once positioned on the O-rings, teflon fences are adjusted inward until projections on the head of the fences engage and grasp the ends of the workpieces. The motor is turned on, causing one set of spindles to rotate. The workpieces supported on the spindle O-rings rotate in a direction opposite that of the spindles. An applicator is guided, either manually or automatically, from one wall to the other. As the applicator passes above the rotating workpieces, a treatment foam applicators carrying refinishing chemicals contact the workpieces. The foam applicators contact the upper portions of the workpieces to prevent disengagement of the workpieces from the spindles. Once completed, the motor is turned off and the spindles and the workpieces cease rotating. Shafts of the fences are lifted and pulled backwards, releasing the ends of the workpieces.

Fingers comfortably fit between the end walls and the unfinished ends of the workpieces, allowing the user to remove the workpieces by touching only the axial ends without touching the finished surfaces.

New features and benefits recognized by the present invention include:

- centerless turning of multiple workpieces
- spindles at one side driven by a variable speed motor
- easy removal of refinished workpieces without having to touch refinished surfaces
- multiple workpieces refinished at one time and requiring only a single pass of the applicator carriage
- applicator carriage guide paths and rails for minimizing human error and for allowing precise applications of chemicals
- quickly movable and finely adjustable fences that provide for effortless retention and release of workpieces of different lengths
- different sized workpieces supported simultaneously by adjusting the O-rings on appropriate spindles
- end walls formed as end plates
- applicators having multiple treatment foam applicators for applying chemicals to multiple rotating workpieces
- overhead carriages for cleaning rotating workpieces and for applying refinishing chemicals to the rotating workpieces.

A centerless refinishing machine has a pair of end walls, multiple rods connecting the end walls, a variable speed motor, three or more multiple spindles extending from each end wall, and O-rings on the spindles. Different models of rollers may be refinished.

Ends of the rollers rest on the O-rings on paired spindles. Several rollers may be refinished at the same time.

A centerless multiple spindle refinishing machine has a pair of end walls. Multiple rods connect the end walls. Three spindles extend from each end wall. Rollers have ends resting on the O-rings on the spindles. A fence extends from each wall above the spindles. A removable guide path and a removable cartridge carry a treatment foam applicator.

FIG. 4 shows a side view of the machine of FIG. 3.

Spindles have O-rings around the front portions of the spindles. O-ring drive belts interconnect rear portions of adjacent spindles and a drive shaft below the spindles.

A centerless refinishing machine may have a pivoted cleaner roller assembly and an automatic applicator driven by a lead screw and spring-urged follower.

The spindles have grooves for drive belts which interconnect the spindles. One spindle has a groove for a power belt which connects that spindle to a drive shaft. The spindles have multiple aligned recesses which receive O-rings to support and rotate the rollers. The drive and power belts are large O-rings.

All grooves are uniform in inner diameter and shape. All recesses are identical. All spindles rotate at the same speed, and the linear peripheral speed of the O-rings is uniform.

These and further and other objects and features of the invention are apparent in the disclosure, which includes the above and ongoing written specification, with the claims and the drawings.

DETAILED DESCRIPTION OF THE PREFERRED EMBODIMENTS

Figure 1:
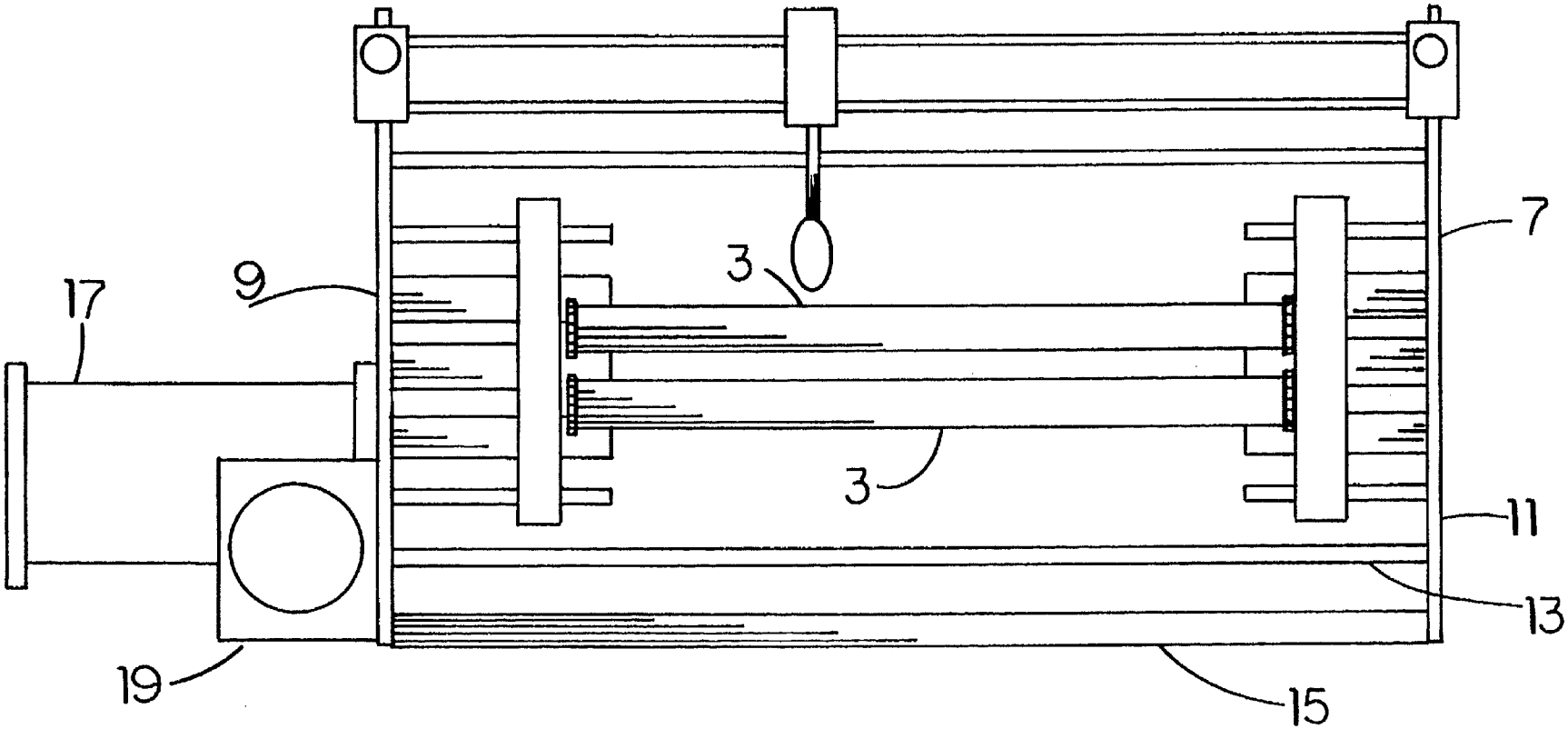
FIG. 1 is a perspective view showing the multiple spindle centerless turning lathe for refinishing rollers of the present invention.
Figure 2:
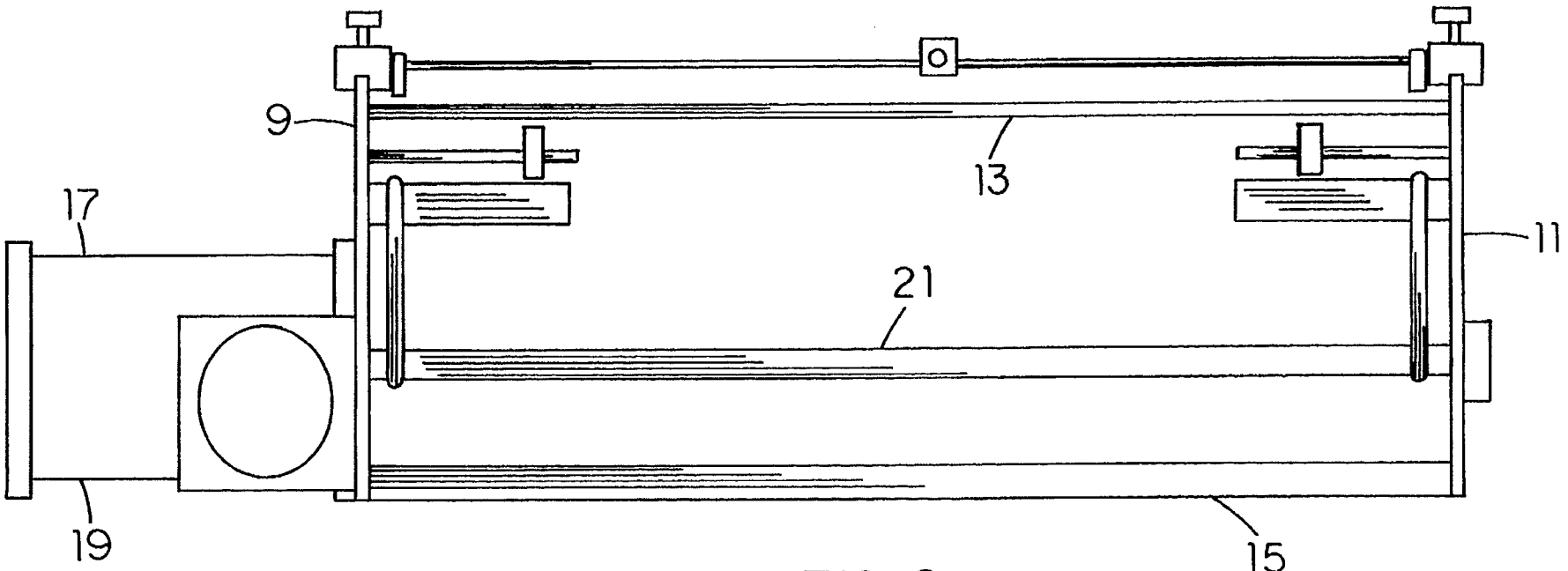
FIG. 2 is a perspective front view showing the apparatus of FIG. 1.

Referring to FIG. 1, a centerless turning lathe 1 supports multiple workpieces 3 and allows multiple workpieces 3 to be cleaned together and to be refinished in a single pass of an applicator. The apparatus 1 includes a housing 7 having opposing first and second end walls 9, 11 and cross members 13 connecting the walls 9, 11. The walls 9, 11 are vertically oriented and generally parallel to each other. Multiple cross members 13 connect the first wall 9 to the second wall 11. In one embodiment, as shown in FIGS. 1 and 2, cross members 13 extend from the four corners of each wall 9, 11. As shown in FIGS. 1 and 2, the lower cross members 13 are housed in non-skid rubber material to act as feet 15. The feet 15 provide stability for the apparatus 1 and allow the machine 1 to be used on rough or non-flat surfaces. A variable speed motor 17 and a speed controller 19 are cantilevered from wall 9.

A drive shaft 21 shown in FIG. 2 extends from the motor between bearings in the walls 9, 11.

Figure 3:
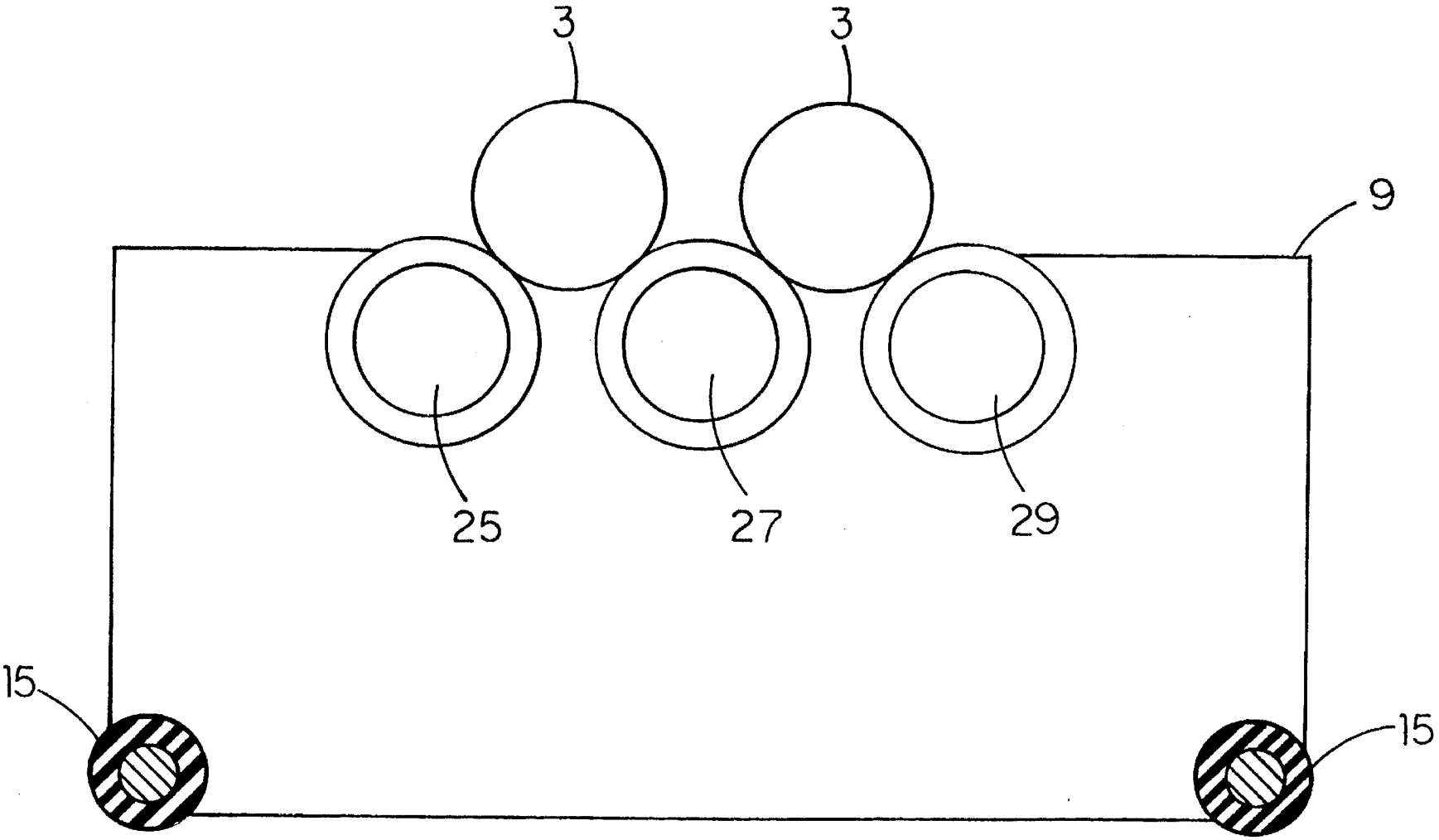
FIG. 3 is a perspective interior view taken from the right to left, showing the apparatus of FIGS. 1 and 2.
Figure 4:
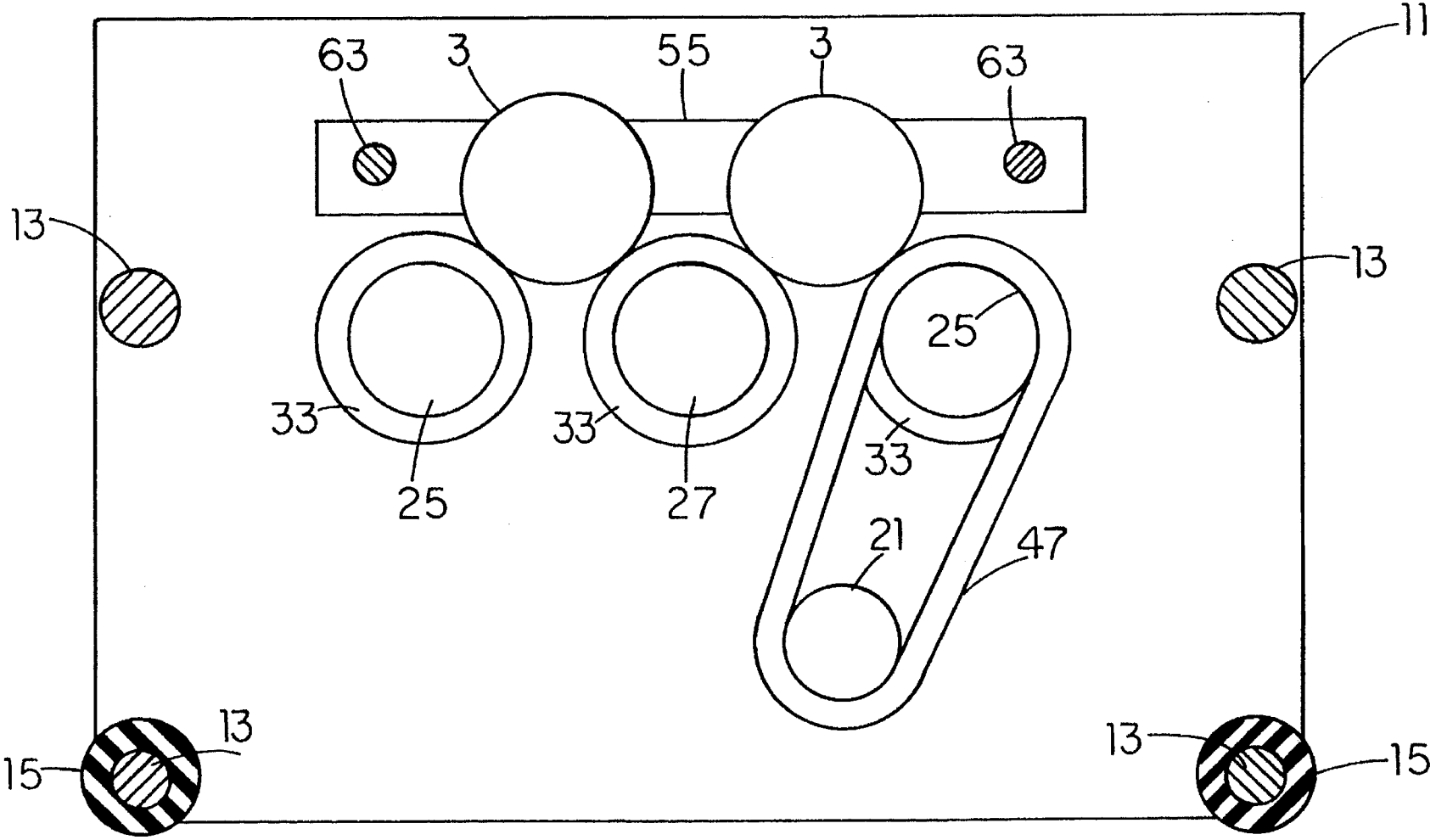
FIG. 4 is a perspective view of the right side of the apparatus shown in FIGS. 1–3.
Figure 5:
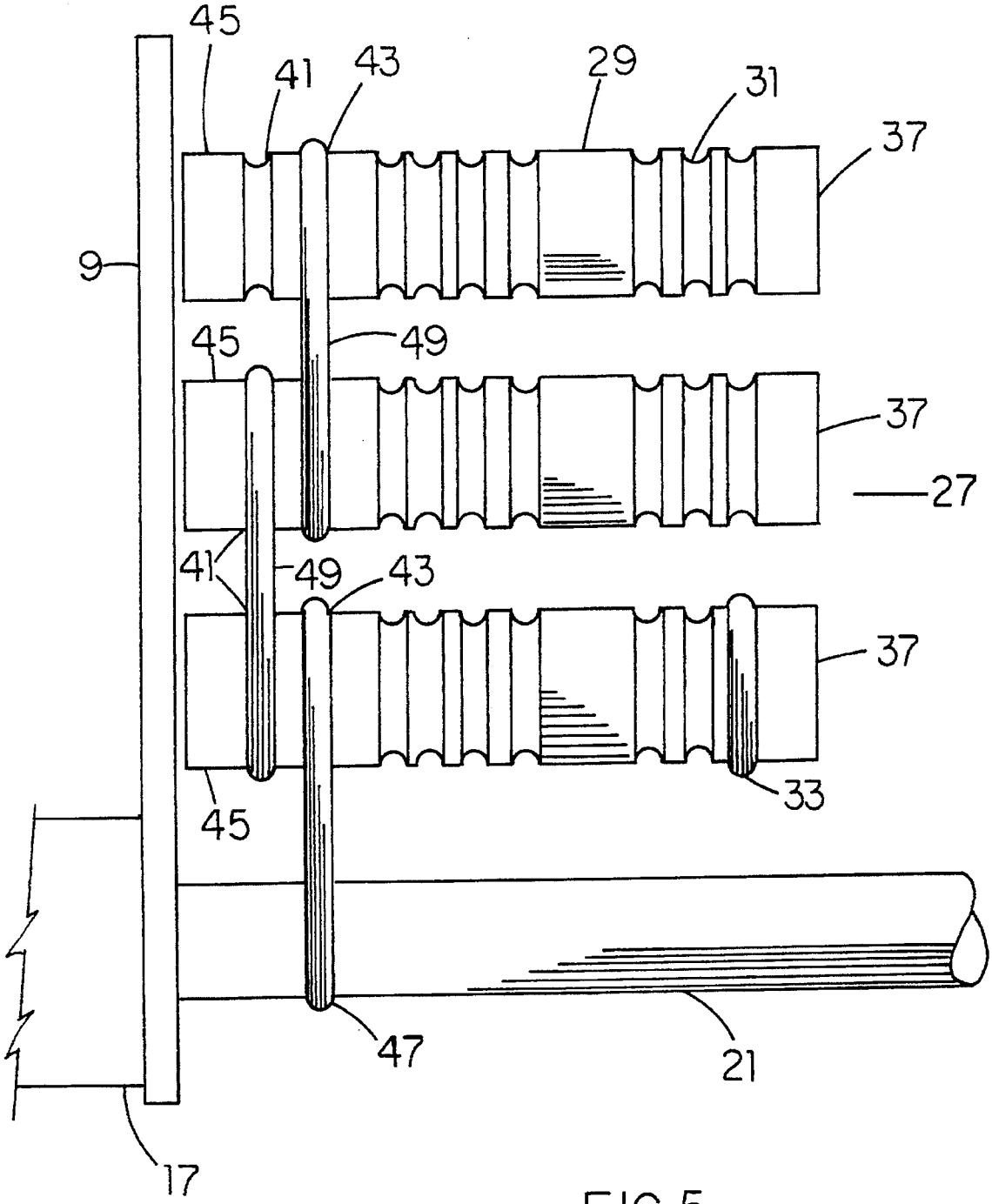
FIG. 5 is a detail of a spindle.

As shown in FIGS. 3 and 4, sets 25, 27, of spindles 29 extend inward from each end wall 9, 11. Preferably, each set 25, 27, has an equal number of spindles 29. As shown in FIG. 5, each spindle 29 has multiple recesses 31 along its length. The recesses 31 extend around the entire spindle 29 and have widths for receiving a standard O-ring 33. The O-rings 33 are easily moved along the length of the spindle 29 from recess to recess for accommodating different length workpieces 3. As shown in FIGS. 1–4 each end of the workpiece 3 rests on the O-rings 33 of adjacent spindles 29. Different sized workpieces 3 can be refinished at the same time by adjusting the O-rings 33 to recesses 31 appropriate for the length of the workpieces 3.

Figure 10:
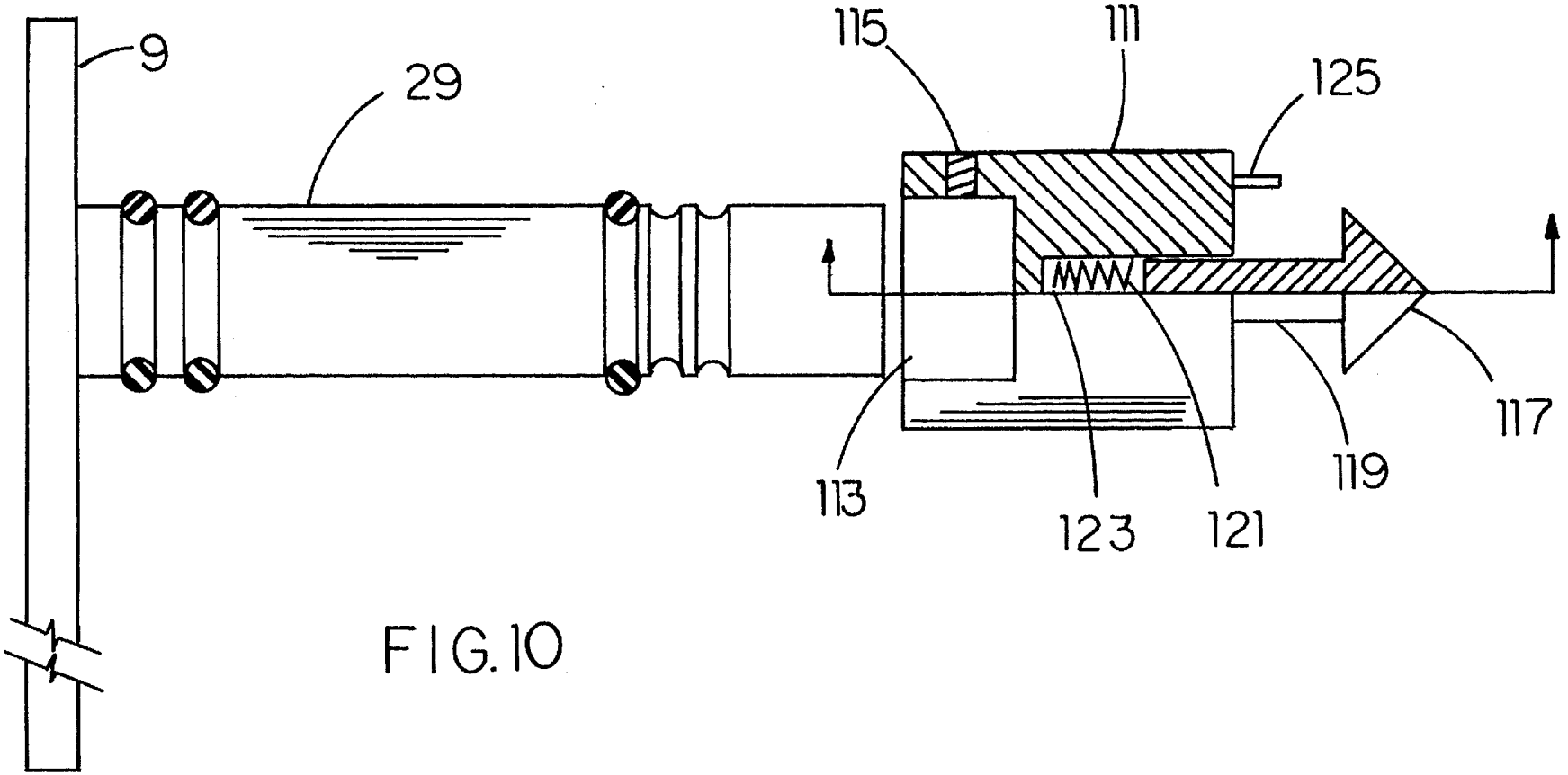
FIG. 10 shows a removable end chuck for fitting on the ends of the spindles and carrying dead centers.

In preferred embodiments, the outer ends 37 of the spindles 29 are adapted for removably holding chucks. As shown in FIG. 10, open backed chucks 111 are fitted on outer ends 37 of the spindles 29 when a short length workpiece 3 requires refinishing.

As shown in FIGS. 3, 4 and 5, each spindle 29 preferably has two grooves or recesses 41, 43 positioned around the back portion 45 of the spindle 29 near the connection of the spindle 29 to the wall 9 or 11. Larger O-rings 47 are fitted in recesses 41, 43 and extend around adjacent spindles 29. The larger O-rings 47 serve as rotating drive belts. A similar larger O-ring 49 connects one spindle in each set to drive shaft 21.

Each set 27 of spindles 29 is rotated by the drive shaft 21 which is driven by a motor 17. The motor 17 is preferably positioned on the wall 9 carrying the set 27 of driven spindles 29. The motor 17 is preferably a variable speed motor that permits fine adjustments in rates of spindle rotation.

As shown in FIGS. 1–4, preferred embodiments of the present invention have fences 55 extending inward from the side walls 9, 11 of the housing 7 for engaging ends of workpieces 3. In preferred embodiments, the fence 55 overlies and covers the sets 25, 27 of spindles 29. Projections 63 extend from the head towards the workpieces 3.

In preferred embodiments, the fences 55 are made of plastic, such as Teflon or polypropylene.

Workpieces 3 are positioned in the housing 7. Each end 35 of the workpieces 3 rests on O-rings 33 of adjacent spindles 29. The sets 25, 27 of spindles 29 are driven by a motor 17. The driven sets 25, 27 of spindles 29 rotate, causing the workpieces 3 to rotate. An applicator cleans the workpieces, and an applicator coats the rotating workpieces 3 with refinishing chemicals.

Figure 6:
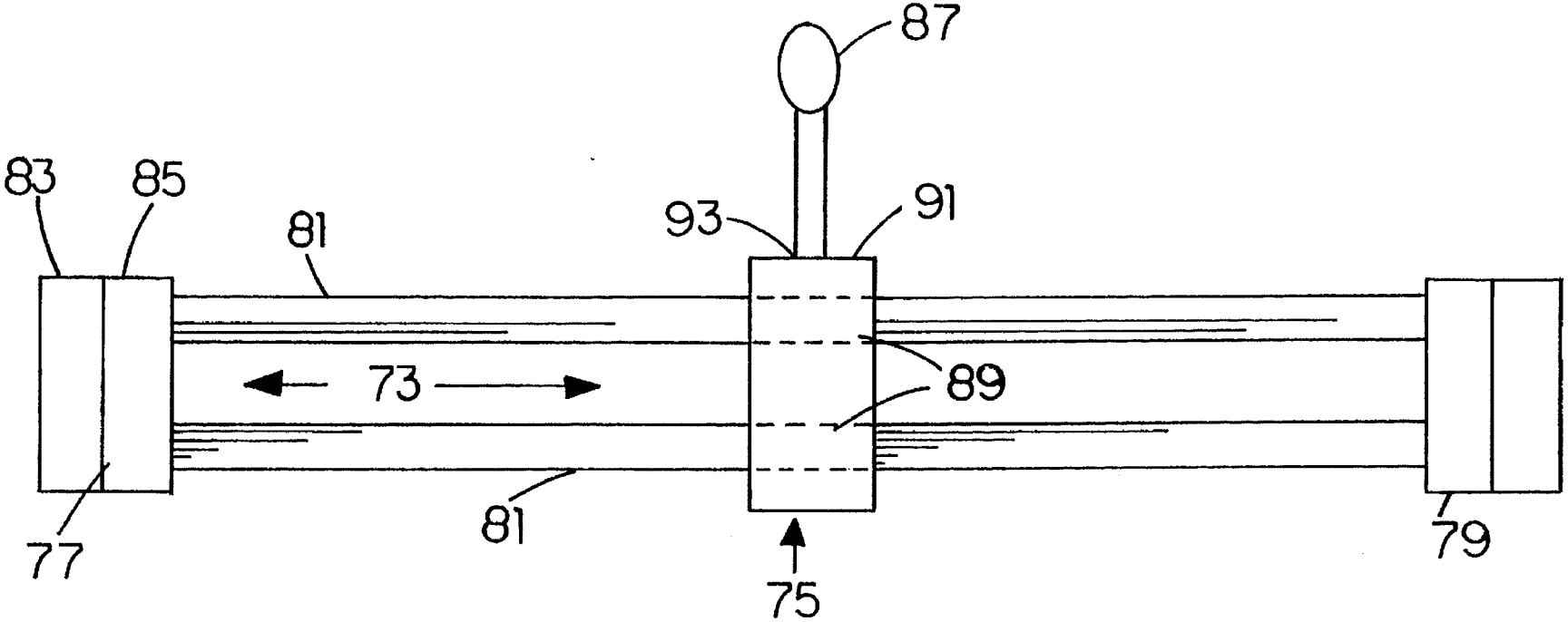
FIG. 6 is a detail of an applicator guide.

FIG. 6 shows a preferred embodiment of a manual applicator 71 of the present invention 1. The applicator 71 includes a guide path 73 and a removable carriage 75. The guide path 73 extends between the end walls 9, 11 of the machine 1. In preferred embodiments, the guide path 73 includes a first mount 77, a second mount 79 and a pair of rails 81 extending between the first and second mounts 77, 79. The first mount 77 engages on one wall 9, and the second mount 79 engages on the second wall 11. Preferably, no connectors are needed to hold the mounts 77, 79 on the walls 9, 11. In preferred embodiments, the mounts 77, 79 are L-shaped, having a first part 83 that rests along the top of the wall and a second part 8B that extends down the inner surface of the wall. In preferred embodiments, two rails 81 extend between the mounts 77, 79 forming the guide path 73. The rails 81 are oriented such that, as the carriage 75 traverses the rails 81, the foam-tipped treatment applicators 87 extending from the carriage 75 contact workpieces 3 at their upper points of rotation. In preferred embodiments, the removable carriage 75 is a six sided block. The carriage 75 preferably has grooves in its lower surface 89 for receiving the rails 81 of the guide path 73. The inner side 91 of the carriage 75 has holes 93 for receiving ends of treatment foam applicators 87. Preferably, a screw extending from the upper surface of the carriage 75 is tightened for securing the foam applicators 87 in the carriage 75 and is loosened for releasing, removing and replacing the treatment foam applicators 87.

The removable carriage 75 is hand-operated. As the workpieces 3 rotate, the carriage 75 is gradually moved across the rails 81 of the guide path 73. The guide path 73 is easily removed from and repositioned on the end walls 9, 11 of the housing 7.

The invention provides speedy, repeatable and accurate cleaning and coating of cylindrical workpieces 3.

Figure 7:
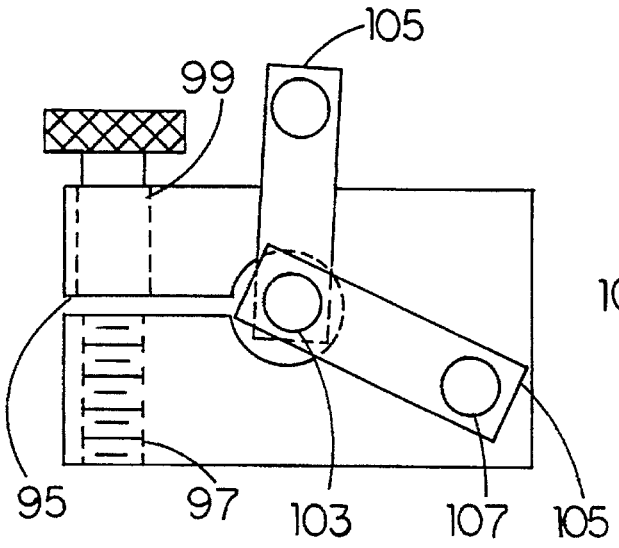
FIG. 7 is a side elevation of an applicator guide mount.
Figure 8:
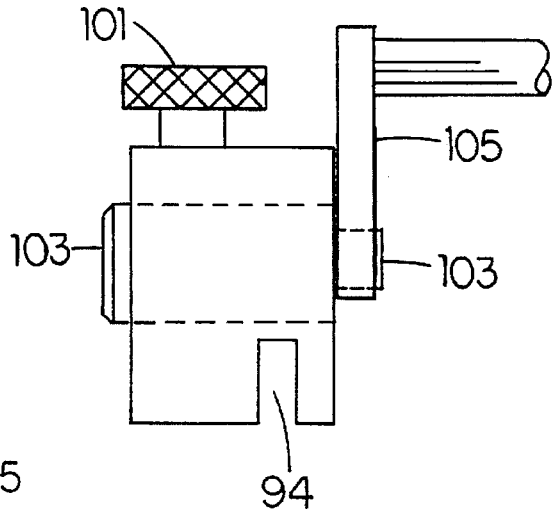
FIG. 8 is a front elevation of one end of the applicator guide mount.
Figure 9:
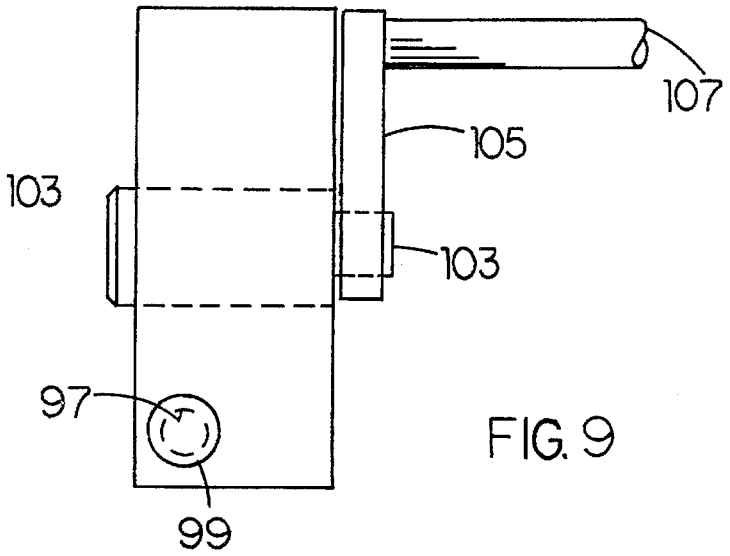
FIG. 9 is a plan view of the guide mount shown in FIG. 7.

As shown in FIGS. 7, 8 and 9, the guide mounts may be adjustable. Adjustable guide mounts 91 are mounted on each top of the ends 9 and 11 by grooves 94. The mounts have a clamping groove 95, a threaded bore 97, and a larger bore 99, which receive the knurled head clamping screw 101. The clamping screw clamps shaft 103 in any of desired positions to hold arm 105 in fixed position, with a guide rail 107 in a desired position to guide a hand-held applicator.

As shown in FIG. 10, the spindles 29 receive end chucks 111, which have recesses 113 for receiving the ends of the spindles 29. A set screw 115 clamps the chuck on the spindle.

Live or dead centers 117 are mounted on shafts 119, which are spring 121 loaded within axial recesses 123 in the ends of the chucks 111. The centers 117 may be live or dead centers. The rollers are driven with dogs 125 which extend from at least one chuck 111 and engage openings in ends of the work to be treated.

Figure 11:
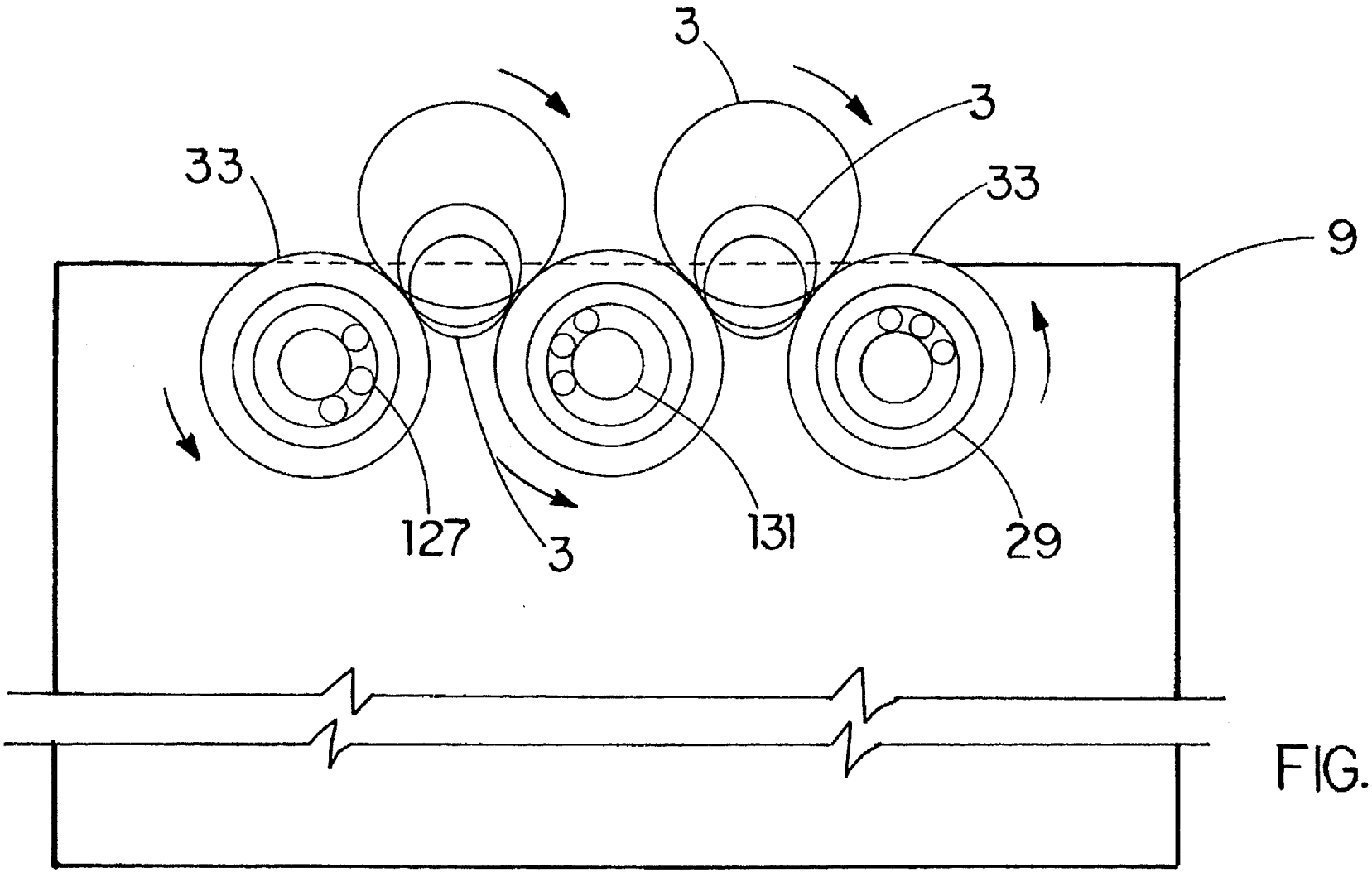
FIG. 11 is a schematic detail showing the varied sizes of rollers to be treated and mounted between adjacent spindles.

FIG. 11 shows the mounting of varied size rollers on the O-rings 33, which are mounted on the spindles 29, and schematically shows the ball bearing mountings 127 which support the spindles. The spindles have a stainless steel axle 131 extending through the entire spindle 29, and bearings 127 and raceways are mounted in ends of the spindles 29 to make the spindles 29 freely rotating on the axles 131. The axles 131 are attached to each end plate such as by threading.

While the invention has been described with reference to specific embodiments, modifications and variations of the invention may be constructed without departing from the scope of the invention, which is defined in the following claims.

I claim:

1. Multiple spindle apparatus for refinishing rollers comprising a first wall, a second wall, multiple rods connected between the first wall and the second wall, a first set of spindles extending inward from the first wall, a second set of spindles extending inward from the second wall, wherein each spindle in the set of spindles has at least one recess, belts for interconnecting adjacent pairs of spindles in each set, O-rings extending around each spindle and resting in the recesses of the spindles for supporting a drive shaft extending between edges of workpieces, a motor connected to the first set of spindles extending from the first wall for rotating the spindles in the first set of spindles in the same direction, a first fence extending through a first opening in the first wall, a second fence extending through a second opening in the second wall, and at least one applicator contacting plural workpieces for applying chemicals to and refinishing the workpieces.

2. The apparatus of claim 1, wherein the spindles have outer ends with adapters and further comprising chucks positioned over the outer ends of the spindles for accommodating shorter length workpieces.

3. The apparatus of claim 1, further comprising a guide connected to and extending between the first wall and the second wall near tops of the walls, a removable carriage for traveling along the guide and wherein the at least one applicator extends inward from the carriage above the workpieces.

4. The apparatus of claim 3, wherein the guide has a first mount positioned on the first wall, a second mount positioned on the second wall, and at least one rail extending between the first mount and the second mount.

5. The apparatus of claim 3, wherein the carriage is a hand-operated carriage having a bottom, an inner side, at least one groove in the bottom and at least one hole in the inner side for carrying the at least one applicator.

6. The apparatus of claim 5, wherein the carriage has multiple holes vertically aligned in the inner side of the carriage.

7. The apparatus of claim 3, wherein the mounts are L-shaped and have a first segment that rests on a top edge of the wall and a second segment that extends along an inner surface of the wall.

8. The apparatus of claim 3, wherein the carriage has a top surface, a bottom surface, an inner surface, an outer surface, a left surface and a right surface, at least one groove in the bottom surface for receiving the guide, at least one hole in the inner surface for carrying the at least one applicator and a screw extending from the top surface for releasing or retaining the at least one applicator.

9. The apparatus of claim 1, wherein each fence has a shaft that extends through the opening, a head connected to the shaft and extending above the set of spindles and projections extending inward from the head for holding workpieces.

10. The apparatus of claim 9, wherein the first opening and the second opening each have a large upper part and a smaller, threaded lower part, and wherein the shaft of each fence is threaded and screws in the lower part of the opening.

11. The apparatus of claim 1, wherein the first wall and the second wall are U-shaped outward facing channels, each channel having a base flange, a vertical web having a bottom end and a top end, the bottom end connected to and extending upward from the base flange, and a top flange extending from the upper end of the vertical web, and wherein the multiple rods extend between and are connected to the vertical web of each channel, and the spindles extend inward from the second part of each channel.

12. The apparatus of claim 1, wherein the first wall and the second wall each have a first vertical part having a top end and a bottom end and a second part connected to the top end, and further comprising a first foot and a second foot connected to the bottom ends of the vertical parts.

13. The apparatus of claim 1, wherein the multiple rods include a first rod extending between and connected to upper left corners of the walls and a second rod extending between and connected to upper right corners of the walls, and wherein the at least one applicator is an automatic applicator, the automatic applicator comprising a carriage that travels along the first and second rods, a lead screw extended between the first and second walls, connected for driving by the motor and engaged with the carriage for driving the carriage along the first and second rods, a spring-urged follower connected to the lead screw and to the carriage that travels along the first and second rods and a trip that trips out the follower connected at an end point of the lead screw for causing the follower to disengage the lead screw, stopping the carriage, and wherein the applicator comprises at least one treatment foam applicator extending from the carriage and touching the workpieces.

14. The apparatus of claim 1, wherein the motor is a DC motor having variable speed control.

15. The apparatus of claim 1, further comprising a hand-moved carriage and the at least one applicator extending from the carriage for applying chemicals to the workpieces.

16. The apparatus of claim 1, wherein the multiple rods include a first rail extending between and connected to upper left sides of the walls and a second rail extending between and connected to upper right sides of the walls, and further comprising a roller pad carriage movably mounted on the first and second rails for traversing the rails.

17. The apparatus of claim 16, wherein the roller pad carriage comprises a first housing for receiving the first rail, a second housing for receiving the second rail, a parallel crossbar extending between the first and second housings, a roller mount pivotally connected to the parallel crossbar, a roller positioned on the roller mount and a handle connected to the roller mount for moving the roller into and out of contact with the workpieces.

18. A centerless turning lathe comprising a pair of opposing walls, a set of spindles extending inward from each wall, each set having at least two spindles, an O-ring positioned around each spindle, belts interconnecting adjacent spindles, and a motor for driving the spindles, and wherein each of the spindles have multiple recesses for receiving the O-rings.

* * * * *